US006814184B1

(12) United States Patent
Blinn, Jr.

(10) Patent No.: US 6,814,184 B1
(45) Date of Patent: Nov. 9, 2004

(54) HIGH RIGIDITY VERTICAL COLUMN MEMBER AND STRUCTURE AND HOIST PLATFORM SYSTEM

(76) Inventor: Lawrence Blinn, Jr., 211 Jewett Rd., Upper Nyack, NY (US) 10960

( * ) Notice: Subject to any disclaimer, the term of this patent is extended or adjusted under 35 U.S.C. 154(b) by 0 days.

(21) Appl. No.: 09/794,474

(22) Filed: Feb. 27, 2001

(51) Int. Cl.[7] ..... E04G 1/00

(52) U.S. Cl. ..... 182/178.1; 182/186.7; 182/141

(58) Field of Search ..... 182/186.7, 178.1, 182/179, 141

(56) References Cited

U.S. PATENT DOCUMENTS 2,723,107 A * 11/1955 Parker
3,190,405 A * 6/1965 Squire ..... 52/637
3,688,461 A 9/1972 Rensch
4,122,646 A 10/1978 Sapp
4,262,773 A * 4/1981 Basham
4,514,940 A 5/1985 Manderla
4,560,074 A * 12/1985 Manning
4,745,412 A 5/1988 Creaser, Jr.
4,803,819 A * 2/1989 Kelsey
5,095,677 A 3/1992 Godbout et al.
5,240,089 A * 8/1993 Spera
6,223,494 B1 * 5/2001 Bright ..... 52/653.1

* cited by examiner

*Primary Examiner*—Alvin Chin-Shue
(74) *Attorney, Agent, or Firm*—Morgan & Finnegan, LLP

(57) ABSTRACT

A high-rigidity structure is formed using vertical column members comprising hollow right cylinders with four integral, radially-projecting, equally-spaced flanges. The flanges have a plurality of holes for mounting structural elements along the length of the columns. A set of platforms may be supported by structure that resides in the space immediately below the platforms, thus access to the platforms is unobstructed by support structure for the platforms above. This arrangement allows the platform to be serviced by hoists from more than one side, and for access from the hoists to be unobstructed.

7 Claims, 4 Drawing Sheets

HIGH RIGIDITY VERTICAL COLUMN MEMBER AND STRUCTURE AND HOIST PLATFORM SYSTEM

BACKGROUND OF THE INVENTION

The present invention relates to structural assemblies used as scaffolding, towers and shoring systems, and more particularly to lightweight, ultra-rigid assemblies that allow for unbraced lengths that are greater than is possible with conventional structural systems.

Structural assemblies used for building scaffolding have a variety of requirements. First, such assemblies must retain structural integrity in a variety of loading conditions. Scaffolding structures are often used to support personnel, equipment, and materials to be used in building construction or renovation. These represent structural loads that are delivered to and removed from platforms within the scaffolding by hoists. The heights to which such loads must be supported can exceed 1500 ft. In addition to vertical loads on the scaffolding structure, lateral loads can be introduced by winds or unbalanced load distributions within the structure itself. The consequences of failure of such scaffolding could entail injury or loss of life to personnel within the scaffolding or on the ground in the immediate vicinity of the site, equipment damage and project delays. Thus, the structural integrity of scaffolding can be crucial.

Scaffolding can also be subject to other demands dictated by the particular application. For example, there may be a requirement for local openings in the lattice structure of the scaffolding to accommodate the loading and unloading of bulky materials or equipment from the hoist at specific elevations. Such openings in the lattice structure can represent potential weaknesses in the overall structure that must be corrected with additional local stiffening. A structural scaffolding assembly must be able to accommodate such local openings and the attendant local stiffening. As a scaffolding system, the structure must also be easily assembled and disassembled using interchangeable parts that are relatively easily transported. Of course, low cost is a factor in any scaffolding design.

SUMMARY OF THE INVENTION

The present invention of a high-rigidity structure comprises a plurality of vertical column members, wherein the vertical column members are hollow right cylinders with four equally-spaced radial flanges of equal height extending outwardly therefrom, wherein the flanges have a plurality of regularly spaced holes for mounting structural members.

In an alternative embodiment, the vertical column members are extrusions having flanges integral with the hollow right cylinders. In further embodiments, the hollow right cylinders have an annular cross section, the annulus has an inner diameter of approximately 3 to 6 inches, the flanges extend radially from an outer diameter of the annulus approximately 2–4 inches, and the annulus and flanges have thicknesses of 0.3–0.8 inches.

In yet other embodiments, the invention relates to a hoist platform system comprising a high-rigidity scaffolding structure for supporting an elevated platform, a first hoist for lifting material to a first edge of the platform, and a second hoist for lifting material to a second edge of the platform, wherein access to the platform from the hoists is unobstructed.

BRIEF DESCRIPTION OF THE DRAWINGS

Further explanations regarding the invention will be given with the aid of the following description, reference being made to the drawings wherein.

DESCRIPTION OF PREFERRED EMBODIMENT

The present invention has as its object the improvement of structural members and assemblies.

Figure 1:
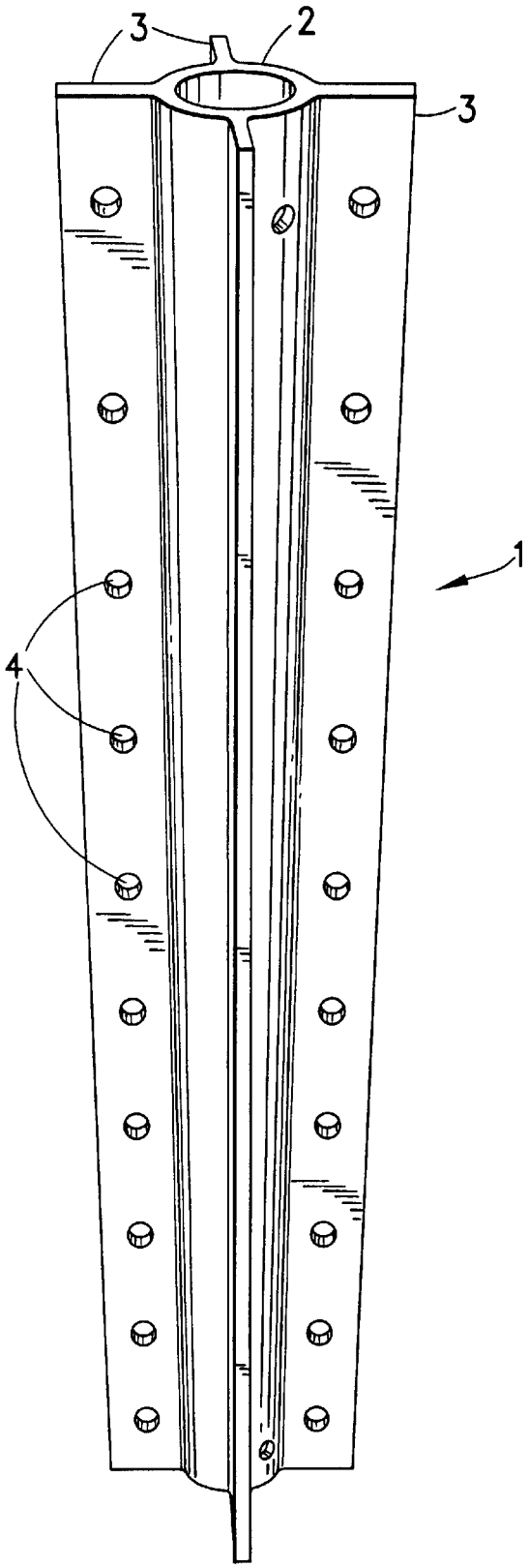
FIG. 1 shows an isometric view of a column member.

According to the invention, a variety of structural members are used to assemble a scaffolding that incorporates platforms that support loads imposed by equipment and materials. A column member according to one embodiment of the invention is shown in isometric view in FIG. 1. The column member comprises an extruded hollow right cylindrical annulus with four equally-spaced exterior radially-projecting flanges. The flanges have regularly spaced holes for ease of attachment of other members at a multitude of vertical locations. Such column members can extend to lengths of over 25 ft. each. The column members are the prime vertical supports in the scaffolding structure. The column members are arranged such that two of the flanges extending from the annulus of each column member are directed toward the opposing column members within the scaffolding assembly (the "interior flanges"), and the other two are directed outside the scaffolding assembly (the "exterior flanges").

Figure 2:
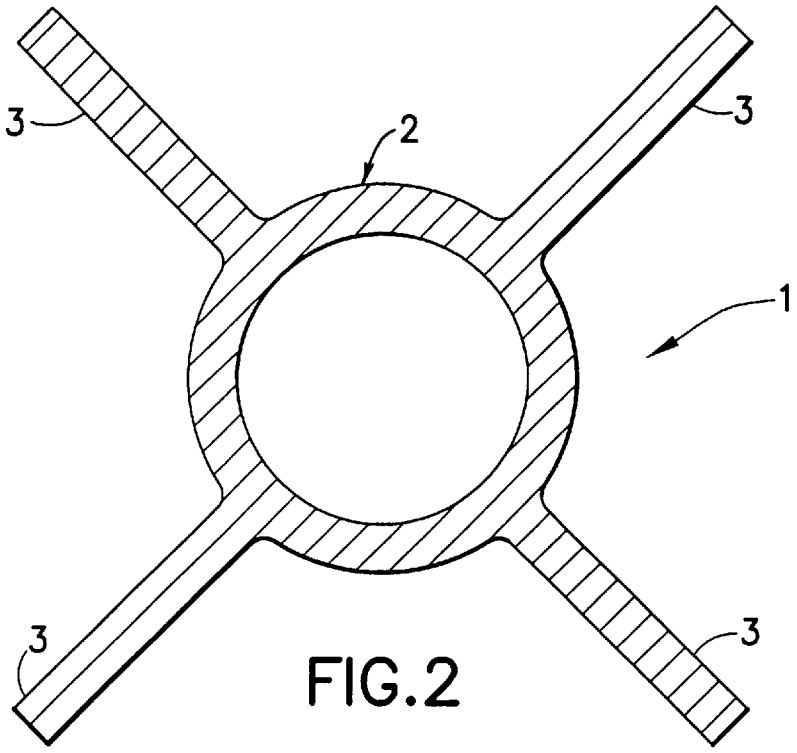
FIG. 2 shows a section view of a column member.

A cross section of a column member of one embodiment of the invention is shown in FIG. 2. Column members can be extruded from a variety of aluminum alloys for strength and light weight. For most applications, inner diameters are between 3 and 6 inches and wall thicknesses are between 0.3 and 0.8 inches. Flanges extend radially from the outer diameter for lengths of between 2 and 4 inches. Of course, the flanges can be manufactured separately and attached to the vertical column by known means, e.g., welding, riveting, or bolting.

Although FIG. 2 shows an embodiment having a circular cross-section, the invention is not limited to column members of circular cross-section. The term "cylinder" is not limited to solids of circular cross-section, but rather refers to solids of any constant cross-section. Thus, "cylinder" includes without limitation solids having cross-sections that are triangular, square, rectangular, and pentagonal. The "annulus" is the cross-section of the resulting hollow cylinder.

By adding radial flanges 3 to the standard annular column members cross-section, the invention provides advantages in several ways. First, the flanges 3 increase the area moment of inertia about the neutral axis, thus reducing the bending stresses that develop in the column member 1. Of course, lower stresses translate into enhanced load bearing capability and greater allowable unbraced lengths. Of course, radially-projecting flanges 3 are but one embodiment of the invention. Radially-projecting "T" members, other tangential members attached to the flanges at the outer radial extremity of the flanges, or other members of various cross sections which increase the area moment of inertia also fall within the scope of the invention.

A second advantage to the column member design is that it avoids an exceedingly "weak" axis. The distribution of the four radial flanges from the circular cross-section provides equivalent load-bearing capability in each of these four directions. Consequently, the column members do not have to be oriented about their own axes in any particular way. This is in distinction to other common structural member cross sections such as angles, channels and I-beams which require special attention to axial orientation to avoid applying highest loads to weak axes.

A third benefit of the instant column member design is the plurality of regularly spaced holes in each of the four flanges. These holes in the flanges that run the length of the column members provide a ready availability of structural connection points. Structural connections can be made at either interior or exterior flanges. The benefit of this feature is enhanced flexibility in accommodating the scaffolding system to the particular requirements of any specific project site. Platforms can be located with respect to the floors, windows or other features of interest of the building upon which work is to be done.

Figure 3:
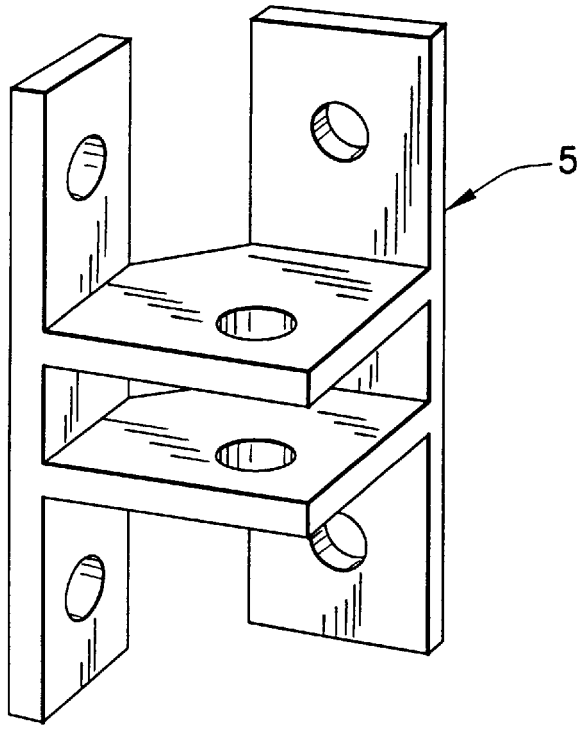
FIG. 3 shows an isometric view of a column joint member.

The invention encompasses various fastening mechanisms for structurally joining the various members (e.g., columns, girts, and braces) used to configure the scaffolding assembly. FIG. 3 shows an isometric view of a column end joint member. This column end joint member is used to structurally join two column members vertically one above the other. The column end joint members also allow for girts and braces to be structurally joined at this location.

The above-described members in combination with girts and braces are used to construct the scaffolding structure and platform support assemblies within the scaffolding structure. Each platform is supported by an assembly of girts and braces. These platform support assemblies also provide rigidity to the overall scaffolding structure. Thus the distance between platform support assemblies represents an unbraced length.

Figure 4:
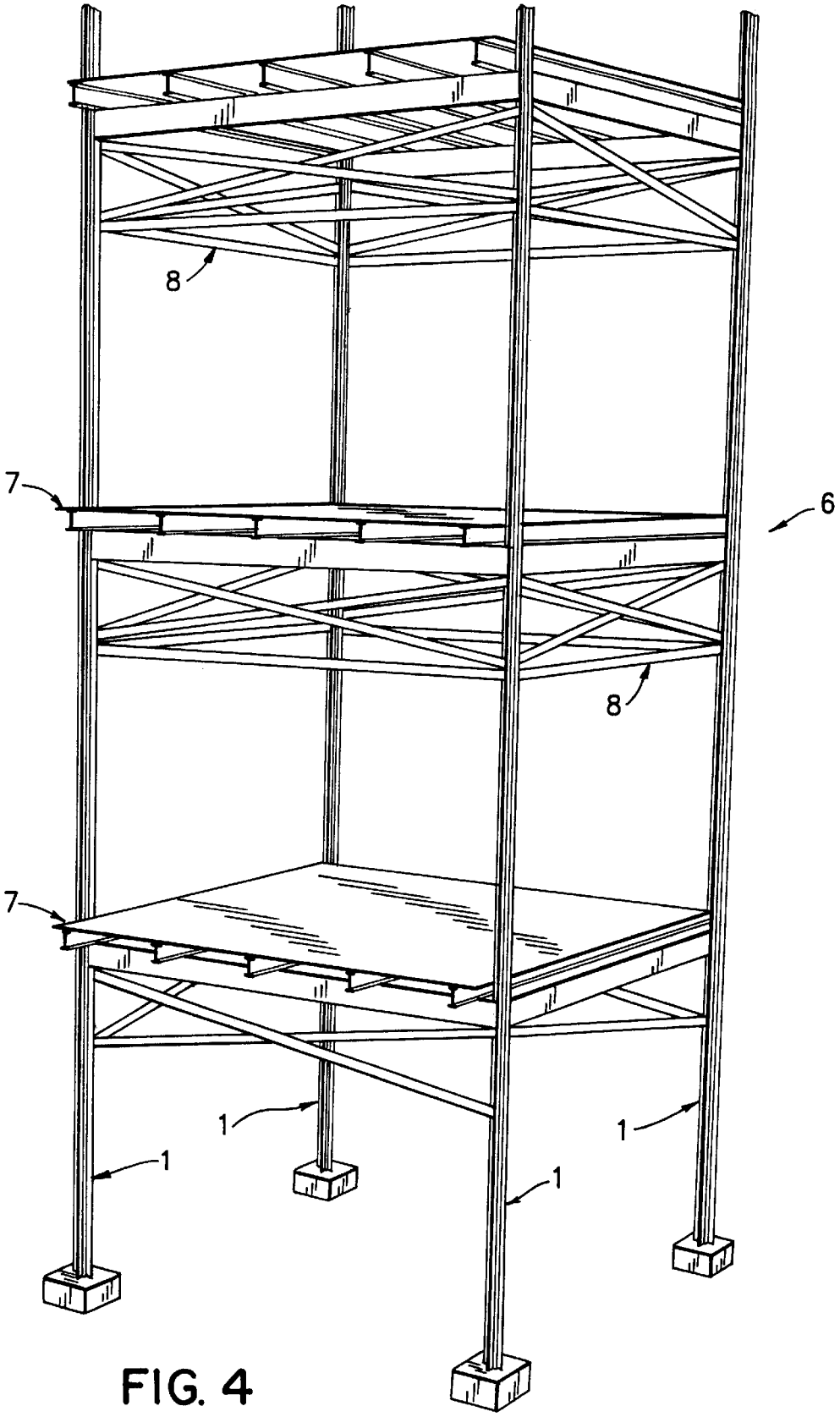
FIG. 4 shows an arrangement of platform assemblies within a scaffolding assembly.

The required platform assemblies are erected within the scaffolding structure as shown in FIG. 4. The scaffolding structure can be adapted to provide square platforms, and also elongated platforms, and may comprise more than four column members. The figure shows the open configuration of the platforms, unencumbered by scaffolding structural elements on any of the four sides of the platform. This maximizes access from the hoists to the platform and from the platform to the building for movement of equipment and materials. The open configuration of the platform sides is made possible by the enhanced stiffness inherent in the column member design in two ways.

Figure 5:
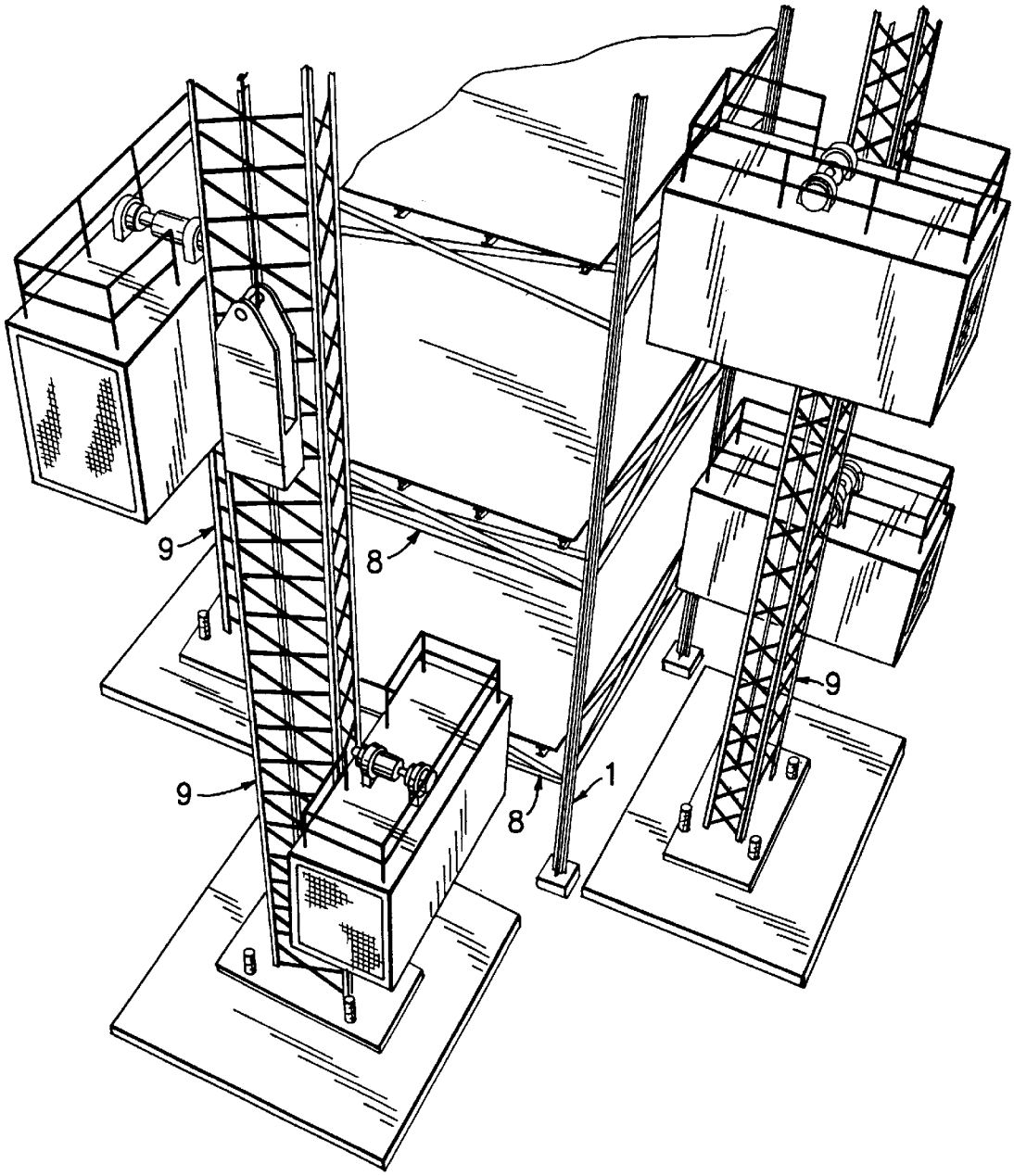
FIG. 5 shows, an arrangement of platform assemblies within a scaffolding assembly and associated hoists.

First, as noted above, the stiffness of the column member design allows for greater unbraced lengths. Second, this enhanced stiffness, in combination with the regularly spaced structural connection points, allows the platform support assemblies to occupy a shorter vertical distance below the platforms. By limiting the vertical depth of the platform support structure to the space immediately beneath the platform, the sides of the platform can be kept free of structure which would otherwise hamper access to the platform. FIG. 5 shows an arrangement of platform assemblies within a scaffolding assembly and associated hoists. Here, due to the open platform configuration, a scaffolding structure-can be serviced by three hoists, one on each of three sides of the scaffolding structure, while the fourth side provides access to the building upon which work is being done. The movement of heavy and bulky equipment and material on and off any one of the hoists or the building is unhampered by scaffolding structure. Scaffolding structures built in this way can extend to elevations in excess of 1500 ft. The ability to arrange the platform support structure such that it does not impede access on any of the four sides of the platform is a direct consequence of the instant invention.

Further modifications will occur to those skilled in this art and such are considered to fall within the spirit and scope of the invention as defined in the appended claims.

What is claimed is:

1. A high-rigidity modular scaffolding or tower structure comprising:

a plurality of stacked units, each unit comprising;

a plurality of vertical column members, forming a rectangular scaffold structure each vertical column member comprising a hollow cylinder, a cross-section of the cylinder having an uninterrupted circular inner contour and a circular outer contour interrupted by four equally-spaced radially-projecting flanges integrally joined to each cylinder of each vertical column member, at the outer contour of the cylinder, at 90 degree intervals about the circumference of each cylinder, wherein the flanges have a plurality of holes that are regularly spaced along the axial length of the flanges; and a support structure having a plurality of substantially horizontal beam members, each horizontal beam member affixed to an upper most hole of a radially-protecting flange of two adjacent vertical column members, the horizontal beam members spanning between and attaching adjacent vertical column members;

a rectangular floor platforms supported by the support structure; and diagonal bracing members at only upper ones of said plurality of holes affixed to the vertical column members, spanning between and attaching adjacent vertical column members, the diagonal bracing members being arranged substantially immediately below the support structure, the vertical column members below the diagonal bracing members being free of attachment therebetween, forming an open frame work providing unencumbered access to the floor platform on all sides of the scaffold structure; the plurality of vertical column members each being joined end-to-end one above another by a column end joint member to form said plurality of stacked units.

2. The high-rigidity structure of claim 1, wherein the circular inner contour has a diameter of approximately 3 to 6 inches.

3. The high-rigidity structure of claim 1, wherein the flanges extend radially from an outer diameter of the circular outer contour approximately 2–4 inches.

4. The high-rigidity structure of claim 1, wherein the cylinder and flanges have thicknesses of 0.3–0.8 inches.

5. The high-rigidity structure of claim 1, wherein the vertical column members are manufactured by extrusion.

6. The high-rigidity structure of claim 4, wherein the vertical column members and flanges are manufactured as an integral unit by extrusion.

7. A hoist platform system comprising the high-rigidity scaffolding tower structure of claim 1, comprising a first hoist for lifting material to a first edge of the platform, and a second hoist for lifting material to a second edge of the platform, wherein access to the platform from the hoists is unobstructed.

* * * * *